175-40 SR
5/15/79 OR 4,154,310

United States Patent [19]

Konstantinovsky

[11] 4,154,310

[45] May 15, 1979

[54] METHOD AND EQUIPMENT FOR DRILLING WELLS

[76] Inventor: Miron S. Konstantinovsky, 13450 Cedar Rd., Apt. 14, Cleveland Heights, Ohio 44118

[21] Appl. No.: 727,171

[22] Filed: Sep. 27, 1976

[51] Int. Cl.[2] ..... E21B 7/00; E21B 1/06; E21B 19/00

[52] U.S. Cl. ..... 175/40; 175/57; 175/99; 175/85; 175/103

[58] Field of Search ..... 175/57, 98, 99, 103, 175/320, 85, 40; 52/108; 242/54 R

[56] References Cited

U.S. PATENT DOCUMENTS

| | | | |
|---|---|---|---|
| 2,013,070 | 9/1935 | Sheridan | 175/103 |
| 3,144,215 | 8/1964 | Klein | 52/108 X |
| 3,367,604 | 2/1968 | Matteo | 52/108 |
| 3,434,674 | 3/1969 | Groskopfs | 52/108 X |
| 3,608,844 | 9/1971 | Tumulty, Jr. et al. | 52/108 |
| 3,631,933 | 4/1972 | Bryant | 61/72.2 X |
| 3,872,932 | 3/1975 | Gosselin | 175/103 |

FOREIGN PATENT DOCUMENTS

| | | | |
|---|---|---|---|
| 1189492 | 3/1965 | Fed. Rep. of Germany | 175/57 |

*Primary Examiner*—Ernest R. Purser
*Assistant Examiner*—Richard E. Favreau
*Attorney, Agent, or Firm*—McNenny, Pearne, Gordon, Gail, Dickinson & Schiller

[57] ABSTRACT

This disclosure relates to apparatus for drilling wells for oil, gas, water, etc., wherein the device for drilling is placed in a rigid cylindrical collar which is expanded and pressed in the walls of the well. The collar absorbs a reactive torque from drilling. In the upper part of the walls of the collar control devices are installed which send up the signals about outside collar pressure, temperature, etc., and thus indicate any complications in the process of drilling. The collar is coaxially joined at its upper end to a thin-walled, continuous tube which is formed from a coiled sheet by drawing the sheet through a rolling-up system of rollers. The tube is axially extended and retracted by a mechanism which has two or more systems of tube moving elements which are symmetrically disposed relatively to a longitudinal axis of the tube and engage the external surface of the pipe column with forces which are sufficient to create the necessary friction forces for moving the tube. As the tube is extended, it draws a continuous sheet through the rolling-up system of rollers. The sheet at the time of the rolling-up embraces communication such as the pipes for feeding liquid to remove earth or rock, the electrical cable, the auxiliary flexible pipe for feeding liquid to a hydraulic cylinder, etc. During retraction, the tube is drawn through the unrolling system of rollers, unrolling it into a sheet which is wound in a coil by the winding mechanism.

19 Claims, 23 Drawing Figures

METHOD AND EQUIPMENT FOR DRILLING WELLS

The present invention relates to apparatus for drilling wells in which continuous elements of the equipment continuously can be lengthened or shortened. The existing apparatus for drilling wells commonly comprise elements which put together separate sections of pipes, electrical cables, etc. In lengthening or shortening them during the process of drilling, a large amount of manual labor is required, with an unproductive loss of time and the use of heavy and expensive equipment. Moreover, the disadvantage of the existing techniques is the difficulty of drilling at an angle inclined away from vertical wells.

The equipment according to the preferred embodiment of the present invention allows the use of continuous elements of the equipment, the length of which must be changed at the time of drilling a well.

The device for drilling is placed in a rigid collar which is joined coaxially with its upper end to the tube. The tube is a pipe with thin walls, which is formed from the coil of a sheet, by drawing the sheet through a rolling-up system of rollers to simultaneously embrace all the communication mains, the flexible pipe for feeding liquid to remove earth and rock, the electrical cable, the auxiliary flexible pipe for the control of the hydraulic cylinder, etc. Drawing the sheet is realized by the mechanism for the moving of the tube, a continuation of which is the sheet. If a rotary device is used for drilling, the collar has radially expandable elements which are moved out and pressed into the walls of the well by a special drive to take up the reactive torque of drilling. Control devices are installed in the walls of the upper part of the collar to send signals upwards about the pressure and the temperature outside on the collar to indicate the possibility of the start of complications in the process of drilling.

The mechanism for moving the tube consists of two special squeezing devices and drives for moving them. The squeezing devices sequentially squeeze the tube and move it by their drive. One squeeze device releases the tube just a short time after another squeezes it. After releasing the tube, each squeezing device returns to its point of departure. By lifting the tube is drawn through the unrolling system of rollers and is unrolled into the sheet, which is wound in a coil by a winding mechanism. A lowering of the collar with the device for drilling is realized by lengthening of the tube; a raising is realized by shortening it.

When a superdeep well is drilled, the sheet can be used with continuously increasing thickness in the upward direction or sheets can be used which are joined from pieces of sheets with different thicknesses, strength, and specific weights increasing in the upward direction to strengthen the sheet.

Accordingly, an important part of the present invention is the provision of apparatus for drilling wells which allows the use of elements the length of which are changed during the process of drilling. The tube and all communication mains are continuous and can be wound on reels or in coils. As the tube is formed, it embraces all communication mains. An attached collar has parts which are radially expandable and pressed into the walls of the well to take up the reactive torque of drilling and unload the tube from the action of this reactive torque, which permits the tube to be formed from coil of thin sheets and be made to make it as a continuous part.

Another object of the present invention is the use of control devices installed in the upper part of the wall of the collar, which send signals on the pressure, temperature, etc. arising on the outside of the collar. This is easier to realize by using a continuous electrical cable. Those signals indicate the start of any complications during drilling.

Another object of the present invention is the use of continuous tube, formed from the coil of the sheet, the edges of which overlap one another. The tube is decreased in diameter by increasing the amount of overlap in the edges of the sheet.

Another object of the present invention is the use of a mechanism moving the tube which consists of two squeezing devices. The squeezing devices squeeze the tube and move it by their drive (e.g., hydraulic cylinders). Each squeezing device includes a cylindrical collar coaxially positioned to the tube, the walls of which are filled with openings and the axis of which is perpendicular to the longitudinal axis of the pipe column and are positioned in the radial directions. Into these openings plungers are placed, which by creating outside pressure of liquid (e.g., oil) surrounding the collar, are moved in the radial directions, perpendicularly to the longitudinal axis of the tube and squeeze the tube. By relieving pressure the squeezing device releases the tube. In order to prevent a deformation of the tube by squeezing, rigid pieces of a pipe with thick walls are placed inside the tube opposite each squeezing device and are fastened with the joining elements to the corresponding squeezing devices, the upper with the upper and the lower with lower devices, and thus they move together with the corresponding squeezing devices.

Another object of the present invention is a variation in the mechanism for moving the tube. It consists of joined, moving chain elements. The leading branches of these chains are pressed to the external surface of the tube in a radial direction either by springs or by pneumatic or hydraulic cylinders with forces which are necessary to create sufficient friction forces in the zones of contact of the moving elements with the tube. These chains of moving elements are disposed symmetrically relatively to the longitudinal axis of the tube from two or more sides and have drive for moving. In order to prevent the deformation of the tube, the supporting idle rollers which are installed in the frame are placed inside the tube opposite the chains from the moving elements. The frame extends upwards from the tube and is fastened to the foundation.

Another object of the present invention is the use in the apparatus for drilling wells of a rigid pipe, consisting of separate pieces of rigid pipe but together instead of the flexible tube for feeding liquid for the removal of parts of earth or rock during the process of drilling. The length of this pipe is increased or decreased by adding or removing the pieces of a pipe which make up this pipe. This pipe is moved by the drive of the mechanism for moving the tube or by the independent drive with the help of squeezing devices similar to the squeezing devices for moving the tube.

These objects of the invention will become more apparent from the following description and drawings:

FIG. 1 schematically shows the method and equipment for drilling wells of the present invention.

Figure 9:
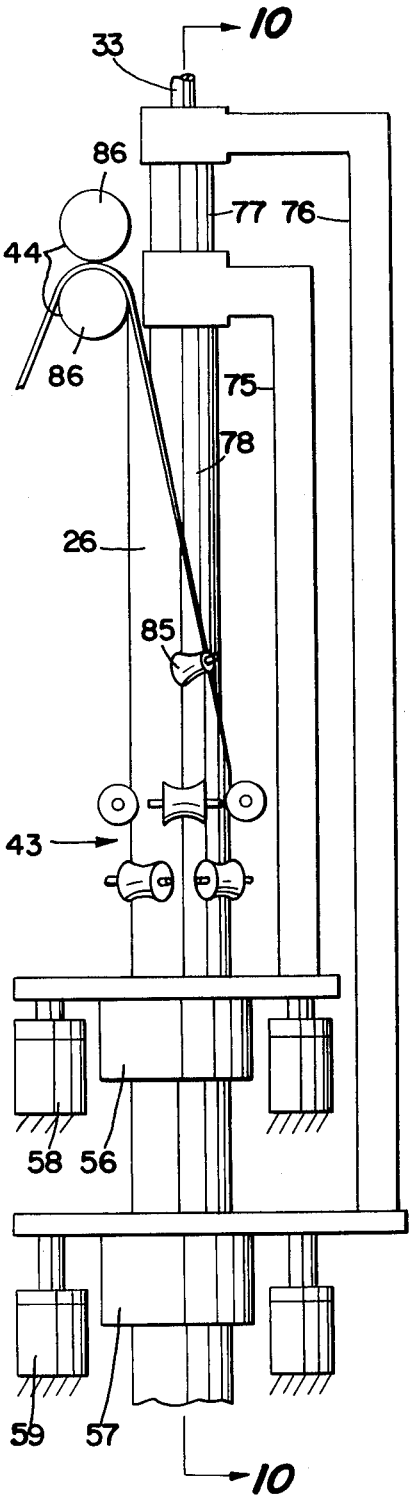

FIG. 9 schematically shows the other variant of the mechanism for moving the tube with a reciprocating movement of the moving elements and with interception.

Figure 10:
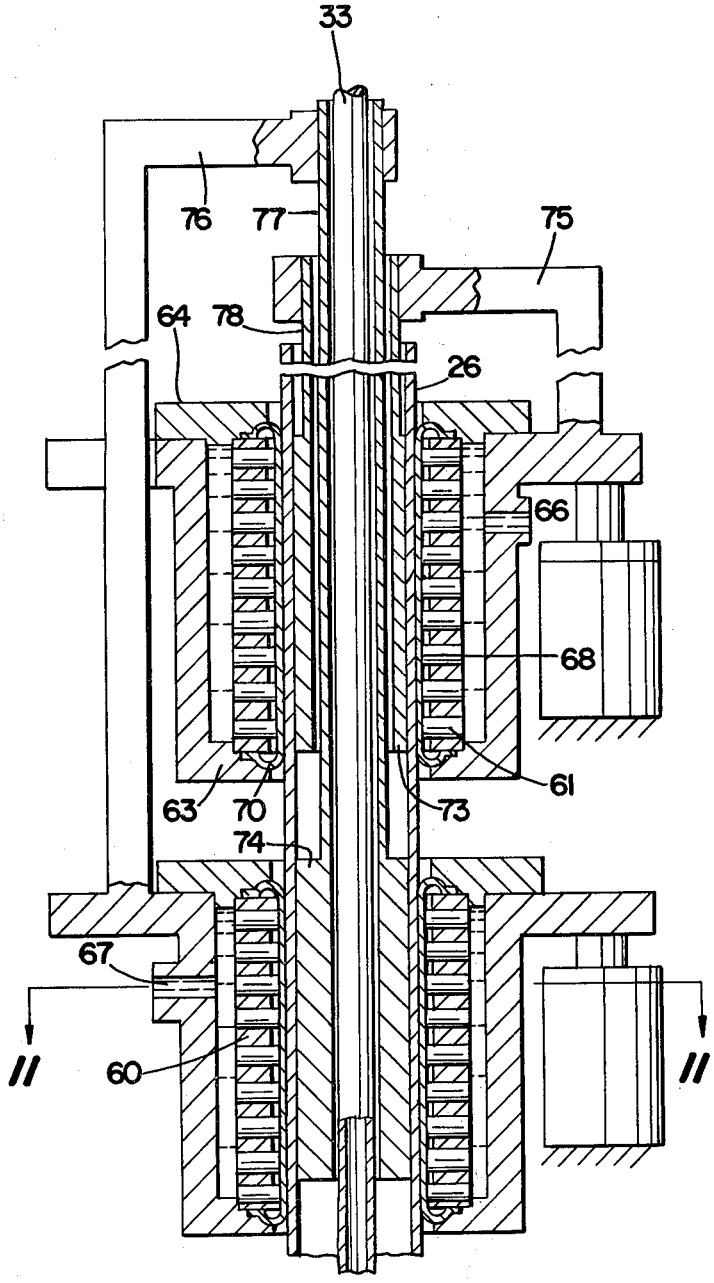

FIG. 10 is a longitudinal sectional view taken along the line 10—10 of FIG. 9.

Figure 11:
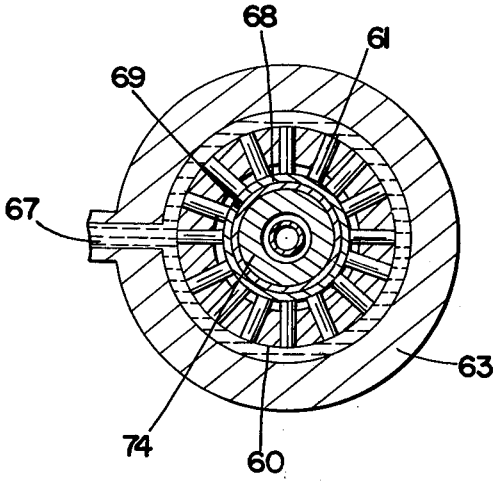

FIG. 11 is a cross-sectional view taken along the line 11—11 of FIG. 10.

FIGS. 12 through 19 show a scheme of the work of the mechanism for moving the tube, as shown in FIG. 9.

Figure 20:
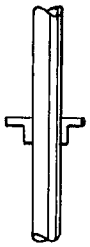
Figure 21:
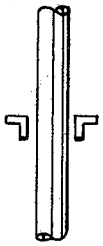

FIGS. 20 and 21 show the conditional signs of the scheme, as shown in FIGS. 12 through 19.

Figure 22:
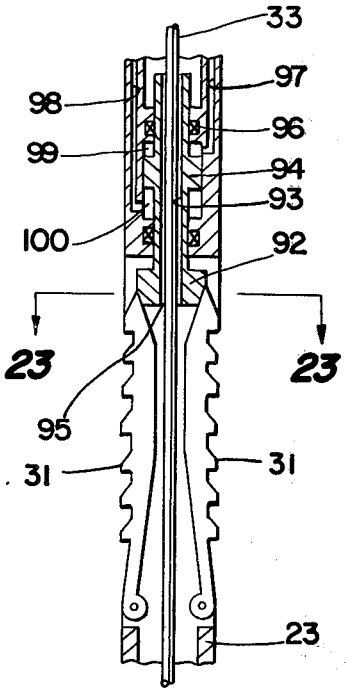

FIG. 22 is a variant of the enlarged longitudinal sectional view of a gripping device.

Figure 23:
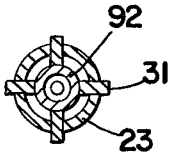

FIG. 23 is a cross-sectional view taken along the line 23—23 of FIG. 22.

The device 21 (FIG. 1) for drilling the well 22 is installed in the cylindrical collar 23 so that reactive forces by drilling are taken up by collar 23. The device for drilling 21 has a central through opening with a longitudinal axis, coinciding with the longitudinal axis of the collar 23. Through the opening 24 liquid is fed for the removal of parts of earth, rock, etc.

Figure 1:
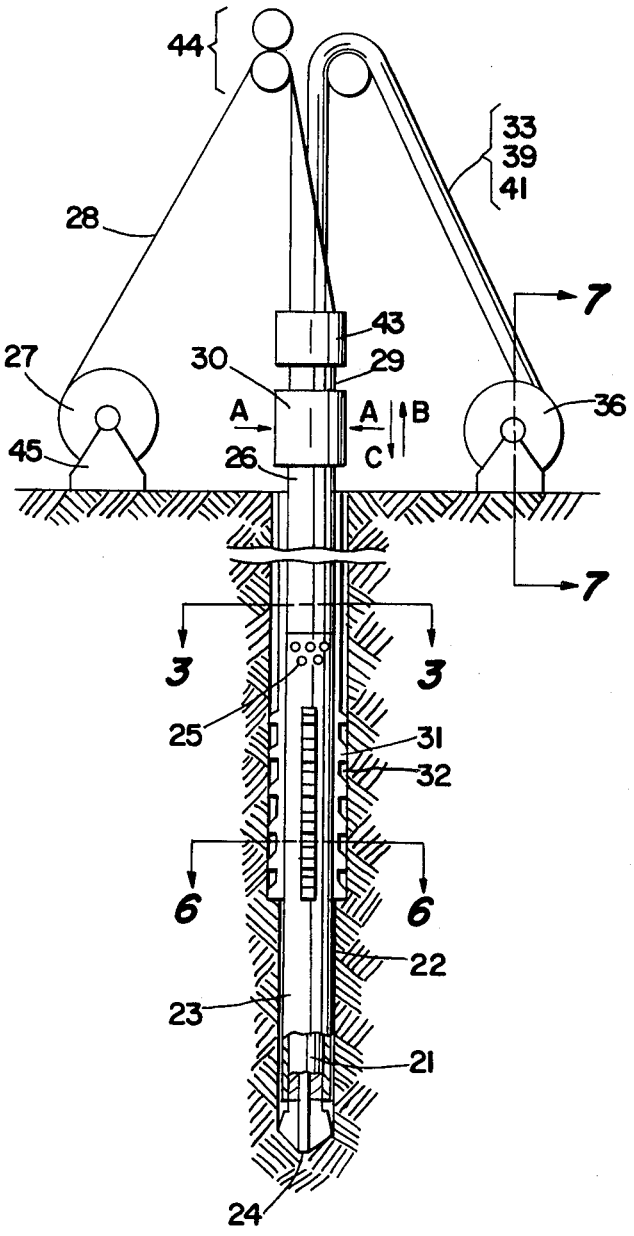
Figure 3:
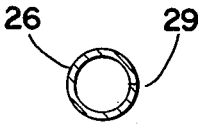
FIG. 3 is an enlarged cross-sectional view taken along line 3—3 of FIG. 1.
Figure 4:
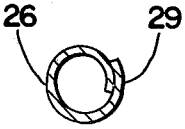
FIG. 4 is an enlarged cross-sectional view which is a variant of the arrangement shown in FIG. 3.
Figure 5:
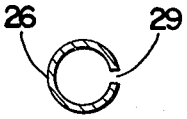
FIG. 5 is an enlarged cross-sectional view which is a variant of the arrangement shown in FIG. 3.

In the upper part of the collar 23 are disposed the control devices 25 which give upwards signals about the pressure, temperature, etc., on the outside of the collar 23. The upper end of the collar 23 is coaxially joined with the tube column 26. The tube column 26 is a continuous pipe with thin walls and the external diameter equals the external diameter of the collar 23. The tube column 26 is formed from the coil 27 of the sheet 28 by a method of rolling-up with the longitudinal joint 29 (FIG. 1 and FIG. 3). The edges of the sheet 28 either just touch each other (FIG. 3) or overlap each other (FIG. 4) or have some clearance between them (FIG. 5).

The tube column 26 is held and moved by the friction forces between its external surface and the surfaces of the moving elements 30 of the mechanism for the moving of the tube column contacting with it (the mechanism for moving the tube column is not shown). To create these friction forces the moving elements are pressed to the external surface of the tube column 26 in the radial direction and perpendicularly to the longitudinal axis of the tube column 26 (as shown by arrows A). When the tube column 26 is lifted the moving elements 30 of the mechanism for the moving of the tube column are moved upwards in the direction shown by arrow B; by lowering of the tube column 26 these moving elements 30 are moved down in the direction shown by arrow C.

The longitudinal reactive force of the well drilling is taken up by the tube column 26 and is passed on to the mechanism for moving the pipe column via its moving elements 30.

Figure 6:
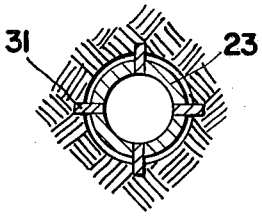
FIG. 6 is a cross-sectional view taken along the line 6—6 of FIG. 1.
Figure 7:
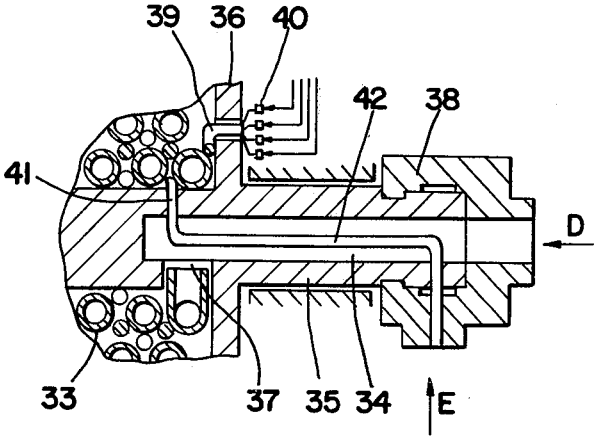
FIG. 7 is a partial enlarged cross-sectional view taken along the line 7—7 of FIG. 1.

The reactive torque in a process of drilling is given to the walls of the well (FIGS. 1 and 6) by the expandable parts 31 of the collar 23. The external surfaces of the expandable parts 31 have cutting elements 32 and lands between them for the removing parts of the earth or rock. If the collar 23 is moved down, the expandable parts 31 are pressed into the walls of the well and cut into it, taking up the reactive torque from the drilling. The liquid for the removal of parts of the earth or rock is fed through the flexible pipe 33 which with one end is joined to the central opening through the opening 24 in the device for drilling 21 and with the other end (FIG. 7) to the central opening 34 in the axle 35 of the reel 36 (see also FIG. 1) on which the flexible pipe 33 is wound, via the radial opening 37. Liquid for the removal of parts of the earth or rock is fed to the opening 34 via a turning joint 38 (as shown by arrow D). The electrical cable 39 supplying energy to device 21 for drilling and for sending and receiving signals for control is fastened to the flexible pipe 33 and connected with one end to the device 21 for drilling, to the control devices 25, and to the device for the control of the hydraulic cylinder for the expandable parts 31, and its other end is connected to the sliding contacts 40 to which is fed electrical energy and which gives and receives the control signals. To the flexible pipe 33 also is fastened the auxiliary flexible pipe 41 for feeding liquid (e.g., oil) to the hydraulic cylinder for expanding the parts 31 of the collar 23.

The auxiliary flexible pipe 41 is joined at one end to the control valve in the collar 23 for the control of the hydraulic cylinder and at the other end through the pipe 42, which passes through the opening in the axle 35 of the reel 36 with the turning joint 38, through the opening in which the liquid is fed (shown by arrow E).

When the collar 23 with the device 21 is lowered for drilling, the flexible pipes 33 and 41 and the electrical cable 39 are embraced with the rolling up from the sheet 28 of the tube column 26. The forming of the tube column from the sheet is accomplished by drawing the sheet 26 through the rolling up system 43 of rollers.

When the coller 23 with the device 21 for drilling is lifted, the tube column 26 is unrolled into the sheet 28 by drawing through the unrolling system 44 of rollers and is wound into the coil 27 by the winding mechanism 45, releasing the flexible pipes 33 and 41 and the electrical cable 39 which are wound on the reel 36.

The order of action for the drilling of the well 22 follows (FIG. 1):

The collar 23 with the device 21 for drilling is fed into the ground by the mechanism for moving the tube column 26. The device 21 crushes into small parts the earth or rock which is removed by the liquid which is fed through the flexible pipe 33 by way of the opening 24 in the device 21 for drilling. When the well 22 has been made so deep that the necessary force for the feeding of device 21 for drilling is created by the weight of the tube column 26, the mechanism for the moving of the tube column 26 ceases to push the tube column 26 down and begins just to lower it with a speed sufficient for creating the necessary feeding forces and the tube column 26 begins to be loaded with the pulling stresses. When it becomes necessary to lift the device 21 for drilling (e.g., for the changing of tools, repairs, etc.), the mechanism for moving the tube column begins to lift the tube column 26 and together with it the collar 23 with the device 21 for drilling. The tube column 26 is unrolled in the unrolling system 44 of rollers into the sheet 28 which is wound on the coil 27 by the winding mechanism 45. Simultaneously, the flexible pipes 33 and 41 and the electrical cable 39 are lifted and wound on their reel by their drive.

If, either directly by drilling the well 22 or in the sufficiently short time after (i.e., until the control devices 25 have not yet passed the place of the beginning of drilling complications) the displacement of the ground or the rock, the moving of sand, considerable increase in temperature or other drilling complications appear, the control device 25 will send the corresponding signals upwards through the electrical cable 39, and the mechanism for moving the tube column begin to lift the collar 23, which is sufficiently firm, from the zone of the beginning complications. That preserves the tube column 26 from action of the complications and damage. After taking precautionary measures the drilling can be continued.

If the complications took place after the collar 23 with the device 21 for drilling had passed the zone of complications, and the tube column 26 has become deformed, the tube column can be lifted by the previous widening from inside with the special device. If, after some decrease in the diameter of the tube column 26 with the variant of the cross-section with the overlapping of the edges of sheet 28 (FIG. 4) by squeezing, the beginning of complications result and the complications are not developed further, the drilling can be continued, because the tube column 26 decreases its diameter without damage just at the expense of increasing the overlapping of edges of the sheet 28.

Figure 8:
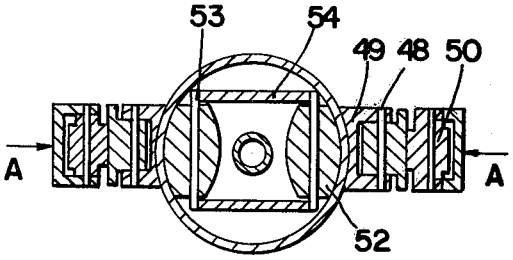
FIG. 8 is an enlarged cross-sectional view taken along the line 8—8 of FIG. 2.

There are two variants of the mechanism for moving the tube column 26: (1) with the continuous movement of the moving element 30, and (2) with the reciprocating movement of the moving elements 30 with the interception. The mechanism for the moving of the tube column 26 with the continuous movement of the moving elements 30 is shown on FIGS. 2 and 8.

It comprises two (possibly three or four) continuous chains 47 which consist of moving elements 49 (which correspond to the moving elements 30 in FIG. 1) hingedly joined by the axles 48. The moving elements 49 have the profile of the surfaces, which contact the external surface of the tube column 26, to create sufficiently large zones of contact (e.g., the arcs of the circle with the diameter equal to the external diameter of the tube column 26). The moving elements 49 are pressed to the external surface of the tube column in the radial direction, as indicated by arrows A, by groups of rollers 50 with the help of springs, pneumatic or hydraulic cylinders or others. The contact surfaces of the moving elements 49 can be covered by special materials or by incisions to improve the engagement with the external surface of the tube column 26. Inside the tube column 26 the system 51 of rollers is placed for taking up the pressing forces from the moving elements 49 to prevent the deformation of the tube column 26. The system 51 of rollers consists of the idle rollers 52 which have a profile of an arc of a circle with the internal diameter of the tube column 26. The rollers 52 are freely rotating on the axles 53 and are perpendicular to the longitudinal axis of the tube column 26 and are parallel to each other, their profiles being in contact with the internal surface of the tube column 26. The axles 53 are installed in the frame 54. The upper end of frame 54 extends upwards from the tube column 26 and is fixed to the foundation by the fastening elements 55.

In FIGS. 9 and 10 are shown the variants of the mechanism for moving the tube column 26 with the reciprocating movement of the moving elements with the interception. This mechanism comprises two squeezing devices: the upper 56 and the lower 57 (FIG. 9) which in turn squeeze and move by their drives 58 and 59, respectively, the tube column 26 which is joined to the collar 23 with the device 21 for drilling. The releasing of the tube column 26 by one squeezing device is done just after it is squeezed by another, as there is an overlapping time element.

The scheme for moving the tube column 26 by this mechanism is shown in FIGS. 12–19. In this scheme the special conditional signs are used for the designation of the squeezing device in the squeezing position (FIG. 20) and in the releasing stage (FIG. 21). The movement of the squeezing devices 56 and 57 is realized by their drives 58 and 59 respectively (FIG. 9). The directions of these movements are designated by arrows which are placed near the conditional signs of the squeezing devices.

Figure 12:
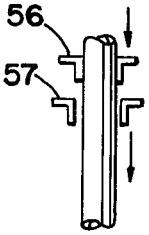
Figure 13:
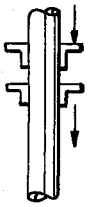
Figure 14:
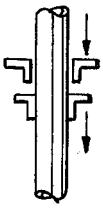
Figure 15:
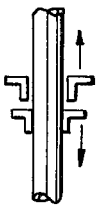
Figure 16:
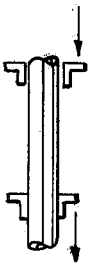
Figure 17:
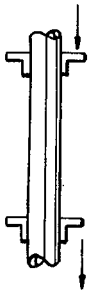
Figure 18:
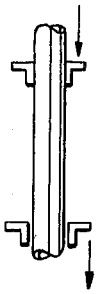
Figure 19:
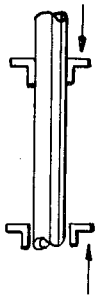

In FIG. 12, the position of the tube column 26 is shown when it is squeezed just by one squeezing device 56 and is moved down by its drive, the squeezing device 57 moving down with the same speed, in the non-squeezing position. During the time of this moving the squeezing device 57 also squeezes the tube column. Both squeezing devices 56 and 57 are moved down with equal speed (FIG. 13) and then the squeezing device 56 releases the tube column 26 (FIG. 14) and begins moving to its extreme upper position and the lowering of the tube column 26 is continued by the squeezing device 57 (FIG. 15). When the squeezing device 56 reaches its extreme upper position it begins to move down with a speed equal to the speed of the lowering of the tube column 26 (FIG. 16), and the squeezing device 56 continues the lowering of the tube column 26 (FIG. 17). When the squeezing device 57 reaches the uppermost position it begins to move down with a speed equal to the speed of lowering of the tube column 26; then the cycle is repeated all over again.

The construction of the squeezing devices 56 and 57 is shown in FIGS. 9, 10, and 11.

Each squeezing device 56 and 57 comprises a cylindrical collar 60 which embraces the tube column 26 and is disposed coaxially with it. The walls of the collar 60 are filled with plungers 61, which are placed in the through openings which are drilled in the walls of the collar 60. The longitudinal axis of these openings are disposed in the radial directions and perpendicularly to the longitudinal axis of the collar 60. The openings are uniformly distributed in the walls of the collar 60 and between them the distance is calculated to secure the sufficient strength of the collar 60. The inside of the collar 60 is embraced by a sealing collar (not shown), made of an elastic material (rubber, plastic, etc.) which is hermetically joined with the ends of the collar securing the sealing of all the plungers 61 from the liquid which surrounds its external surface. The collar 60 with the plungers 61 and the sealing collar are placed in the body 63 and fastened by the cover 64. Between the internal surface of the body 63, the ends of the cover 64, and the external surface of the sealing collar 62, a hermetical space is created, which is filled with liquid (e.g. oil). By creating pressure of liquid via the openings 66 or 67 respectively for the squeezing devices 56 and 57, the plungers 61 are moved in the radial directions to the longitudinal axis of the tube column 26 and squeeze it.

For securing a better engagement with the tube column 26 between the internal surface of the collar 60, and consequently between the ends of the plungers 61, the collar 68 is placed. The collar 68 is made from a material having a high coefficient of friction by contact with the ends of the plungers 61 and the external surface of the tube column 26. The collar 68 consists of two or more sections with compensating clearances 69 (FIG. 11) which permit uniform squeezing of the tube column 26. By breaking off the pressure of the liquid inside the body 63, the sections of the collar 68, which were squeezed to the external surface of the tube column 26 by the plungers 61, are returned to their point of departure by the spring elements 70, which are joined to the ends of the sections of the collar 68 (FIG. 10).

To guarantee the greatest possible application of sufficient squeezing forces without danger of deformation of the tube column 26, on the places of the disposition of the squeezing devices 56 and 57 (FIGS. 9, 10, and 11) inside the tube column 26, pieces of pipes 73, 74, respectively, are placed with relatively large rigidity with an external diameter equal to the internal diameter of the tube column 26. These pieces of pipe 73 and 74 are joined with the bodies of the squeezing devices 56 and 57, respectively, by way of the fastening elements 75 and 76, respectively. The pipe 74 is joined to the fastening element 76 with the help of the pipe 77, with thin walls, which is coaxially joined with it and passes through the piece of pipe 73 and its continuation 78, which is joined with the fastening element 75.

Figure 2:
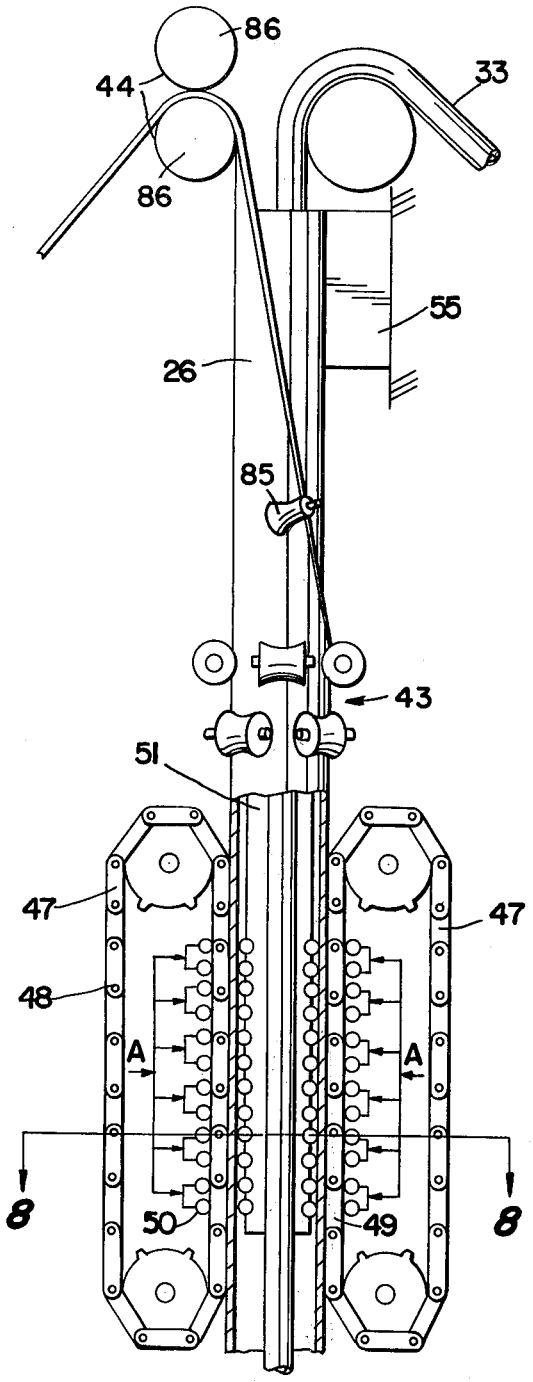
FIG. 2 is a variation of the present invention.

There is shown in FIGS. 2 and 9 system 44 of rollers unfolding the tube column 26 into the sheet 28. It comprises two cylindrical rollers 86 and by necessity the auxiliary pairs of rollers 85 from the rolling-up system 43 of rollers. The tube column 26 is drawn through this system of rollers 43 and is unrolled into sheet 28, which is wound in the coil 27. The drawing of the tube column 26 through the unrolling system 43 of rollers is accomplished by the winding mechanism at the same time as the tube column 26 is lifted by the mechanism for the moving of the tube column.

FIGS. 22 and 23 show the expandable parts 31 with the axis of turning placed in a plane perpendicular to the longitudinal axis of the collar 23 and with the movement of parts 31 in radial directions to that axis. The expandable elements 31 are placed in the collar 23 higher than the device 21 for drilling.

In the upper part of the expandable parts 31 on the inside, inclined surfaces are made. With these surfaces the parts 31 rest on the conical surface 92 at the end of the piston-rod 93 of the hydraulic cylinder which was assembled in the upper part of the collar 23 above the parts 31. The body of the hydraulic cylinder has been made in the walls of the collar 23. The piston 94 with the piston-rod 93 with a conical end 92 have the central through opening 95 along the longitudinal axis through which pipe 33 passes for feeding liquid, used for the removal of parts of earth, rocks, etc., and the electrical cable 29. This hydraulic cylinder has two seals 96 for sealing the piston-rod. The control of the hydraulic cylinder is realized with the help of the valve with the distance control via the channels 97 and 98, and are connected by them with the cavities 99 and 100, respectively.

The mechanism for the expandable parts 31 works as follows: Liquid pressure is fed via channel 97 into the cavity 99. The piston 94 with the piston-rod 93 is moved down and with its conical end 92 presses on the internal inclined surfaces of the parts 31, expanding and pressing them into the walls of the well. When the liquid pressure is interrupted in the cavity 99 and is fed into the cavity 100 via the channel 98, the movement of the piston 94 with the piston-rod 93 is backwards, and also the parts 31 are moved back by springs or by reactive forces.

By necessity to protect from wear the external surface (or both surfaces) of the tube column 26 is covered with a defense layer **26*a*** (e.g., plastic) either before it is formed from the sheet or after, and can be repeated from time to time, depending on the conditions of drilling.

What is claimed is:

1. A well drilling apparatus comprising a drilling device, a continuous cylindrical tube coaxially attached to said drilling device, said continuous tube being adapted to be advanced and retracted to thereby move said drilling device longitudinally in a well being drilled to thereby advance and retract said drilling device, flat sheet means, means to progressively transform said flat sheet means into said continuous tube during advancement of the tube and to progressively transform said tube into said flat sheet means during retraction of said tube, said continuous tube having a longitudinal joint which permits the passage of fluid pressure therethrough to remove hoop stress loading of the tube, means to advance and retract said tube.

2. A well drilling apparatus according to claim 1, wherein said flat sheet means is stored in coil form.

3. A well drilling apparatus according to claim 1, wherein said means to advance and retract said tube comprises at least two endless chains having external surfaces conforming to the external surface of said continuous tube for continuously driving said tube in longitudinal directions, and backup means within said tube to absorb radial pressure by said chains.

4. A well drilling apparatus according to claim 1, wherein said continuous tube is formed from a single flat sheet and wherein longitudinal edges of said sheet are formed into an abutting, contiguous relationship.

5. A well drilling apparatus according to claim 1, wherein said continuous tube is formed from a single flat sheet and wherein longitudinal edges of said sheet are spaced apart.

6. A well drilling apparatus according to claim 1, wherein said tube is formed from a single flat sheet and wherein longitudinal edges of said sheet overlap.

7. A well drilling apparatus according to claim 1, wherein the strength of said continuous tube increases progressively from the drilling device.

8. A well drilling apparatus according to claim 1, wherein the outside surface of said tube is coated with wear protective means.

9. A well drilling apparatus according to claim 8, wherein said wear protective means is a plastic.

10. A well drilling apparatus according to claim 1, wherein said means to advance and retract said tube comprises a pair of squeezing means adapted to reciprocate and to sequentially grip and squeeze said tube and to sequentially and longitudinally advance and retract said tube.

11. A well drilling apparatus according to claim 10, wherein each squeezing means includes a collar having plungers mounted therein and means to advance said plungers radially inwardly toward said tube to grip said tube.

12. A well drilling apparatus according to claim 1, including a continuous supply of control and sensing transmitting means for a drilling operation, and further including a continuous flexible pipe for feeding liquid under pressure to the drilling device, means to advance said control and sensing transmitting means incrementally into the tube as the tube is being formed during advancement thereof and to retract said control and sensing transmitting means incrementally as said tube is being transformed into said flat sheet means during retraction of the tube.

13. A well drilling apparatus according to claim 12, wherein said continuous supply of control and transmitting means is stored in coil form.

14. A well drilling apparatus according to claim 12, including a rigid collar between said drilling device and said tube, said collar having radially expandable elements adapted to be pressed into the walls of the well to absorb reaction torque during the drilling operation.

15. A well drilling apparatus according to claim 14, wherein control and sensing devices are provided in said collar and connected to said transmitting means to provide signals as to drilling conditions.

16. A well drilling apparatus comprising a drilling device, a continuous cylindrical tube coaxially attached to said drilling device, said continuous tube being adapted to be advanced and retracted to thereby move said drilling device longitudinally in a well being drilled to thereby advance and retract said drilling device, flat sheet means, means to progressively transform said flat sheet means into said continuous tube during advancement of the tube and to progressively transform said tube into said flat sheet means during retraction of said tube, means to advance and retract said tube, a continuous supply of control and sensing transmitting means for a drilling operation, means to advance said control and sensing means incrementally into the tube as the tube is being formed during advancement thereof and to retract said control and sensing means incrementally as said tube is being transformed into said flat sheet means during retracting of the tube, a rigid collar between said drilling device and said tube, said collar having radially expandable elements adapted to be pressed into the walls of the well to absorb reaction torque during the drilling operation.

17. A well drilling apparatus according to claim 16, wherein control and sensing devices are provided in said collar and connected to said transmitting means to provide signals as to drilling conditions.

18. A well drilling apparatus comprising a drilling device, a continuous cylindrical tube coaxially attached to said drilling device, said continuous tube being adapted to be advanced and retracted to thereby move said drilling device longitudinally in a well being drilled to thereby advance and retract said drilling device, flat sheet means, means to progressively transform said flat sheet means into said continuous tube during advancement of the tube and to progressively transform said tube into said flat sheet means during retraction of said tube, means to advance and retract said tube, said means to advance and retract said tube comprising a pair of squeezing means adapted to sequentially grip and squeeze said tube and to sequentially and longitudinally advance and retract said tube, each squeezing means including a collar having plungers mounted therein and means to advance said plungers radially inwardly toward said grip to grip said tube.

19. A well drilling apparatus comprising a drilling device, a continuous cylindrical tube coaxially attached to said drilling device, said continuous tube being adapted to be advanced and retracted to thereby move said drilling device longitudinally in a well being drilled to thereby advance and retract said drilling device, flat sheet means, means to progressively transform said flat sheet means into said continuous tube during advancement of the tube and to progressively transform said tube into said flat sheet means during retraction of said tube, means to advance and retract said tube, the strength of said continuous tube increasing progressively from the drilling device.

* * * * *